US005091892A

United States Patent [19]

Secretan

[11] Patent Number: 5,091,892

[45] Date of Patent: Feb. 25, 1992

[54] EXPANDABLE SONAR ARRAY STRUCTURE

[75] Inventor: Stanley Secretan, Leona Valley, Calif.

[73] Assignee: Allied-Signal Inc., Morris Township, Morris County, N.J.

[21] Appl. No.: 689,710

[22] Filed: Apr. 19, 1991

Related U.S. Application Data

[63] Continuation of Ser. No. 494,241, May 13, 1983, abandoned.

[51] Int. Cl.[5] ..... H04R 17/00

[52] U.S. Cl. ..... 367/153; 367/149; 367/173; 310/337

[58] Field of Search ..... 367/3, 4, 6, 149, 153, 367/155, 156, 157, 165, 173; 310/337; 343/709, 881, 915; 211/196

[56] References Cited

U.S. PATENT DOCUMENTS 3,566,346 2/1971 Scopatz .
3,886,491 5/1975 Jonkey et al. .

FOREIGN PATENT DOCUMENTS 2093996 9/1982 United Kingdom ..... 367/153

*Primary Examiner*—Harold J. Tudor
*Attorney, Agent, or Firm*—Terry L. Miller; Robert A. Walsh

[57] ABSTRACT

An expandable sonar array structure includes a central body with a plurality of radially extendable hydrophone support arm assemblies attached to said body and including a motor-driven drive member to which all the arm assemblies are attached through pushrods. Each arm assembly includes three substantially vertically aligned, radially extending arms carrying hydrophones with top and bottom arms attached to the pushrods through short arms with pivots chosen so that the arms move in opposite directions. The center arm is attached to the lower arm by means of a link which closes a parallelogram arrangement such that the center arm moves essentially in parallel with the lower arm. An additional arm is pivotally attached to the outboard end of the center arm and extends the center arm to essentially the diameter of the upper and lower arms, and its outboard end is attached through a link to the outside end of the upper arm.

16 Claims, 3 Drawing Sheets

EXPANDABLE SONAR ARRAY STRUCTURE

This is a continuation of application Ser. No. 06/494,241 filed May 13, 1983 now abandoned.

This invention relates to an expandable sonar array structure which is designed to be placed in the water where it opens at a given depth to make a greatly expanded array for operation and which is then capable of being closed to a much smaller volume before being removed from the water.

The expandable sonar array of the invention includes a body member, a drive member, motor means for driving the drive member, a plurality of radially extendable arms for carrying hydrophones, and means for extending the arms and for folding the arms back adjacent the body member. In the course of attempting to increase the range of airborne sonar systems, one of the techniques which has been explored is that of making a larger array with a capability of operating at substantially lower frequencies. It is known that frequencies in the range of 1000 to 1200 Hz propagate through sea water much more effectively than frequencies in the order of 10 KHz. For effective reception of echo signals, such lower frequencies require a receiving array of considerable size—a size which is impractical to operate from a helicopter. One approach which has been explored is to employ a dipping sonar package which, after lowering into the water, is expanded during operation and then is retracted to a size suitable for handling by the suspending platform during ascent and stowage. The acoustic requirements dictate a receiving array of cylindrical shape providing a vertical arrangement of hydrophones spaced across a diameter defined by the operating frequency as is understood in the art. One such expandable array is disclosed in U.S. Pat. No. 3,886,491 filed in the names of Loren M. Jonkey and Eugene Markus, issued May 27, 1975. At that time it was considered important that the receiving hydrophones be kept together in vertical staves so that the folding parallelogram structure employed translated such vertical staves directly outwardly. This structure, while operable, was not considered sufficiently durable or reliable for the long term, and so efforts have been under way for a considerable time to devise an array structure which is more durable and more reliable. A somewhat similar array structure is shown in Scopatz U.S. Pat. No. 3,566,346, issued Feb. 23, 1971.

The expandable sonar array of the invention is characterized in that it includes a motor in the body connected to a drive member to which all of the hydrophone arm assemblies are attached. Each arm assembly (normally there will be a large number such as sixteen) includes three foldable arms which open to form the horizontally extending members carrying vertically arranged hydrophones. The upper and lower arms have short lever arms at their inner ends driven by pushrods connected to the drive member such that they are positively driven open and closed. A link connected to the lower one of these arms constitutes part of a parallelogram linkage which extends a third arm. Pivotally attached to the end of the third arm is a fourth arm which is connected through a link to the end of the upper arm such that when the upper arm is driven to its extended position, the attached link carries the fourth arm to a horizontal position which is, in effect, an extension of the third arm. Thus the array is positively driven in both opening and closing directions and is maintained in position during the desired time by the drive mechanism. This is contrasted with the Jonkey et al device in which the array relied on buoyance to open when the arms were released. Also, the array structure shown and described herein is believed to be substantially more rugged and dependable in operation than the earlier expanding arrays.

The invention will now be described with reference to the accompanying drawings in which.

Figure 1:
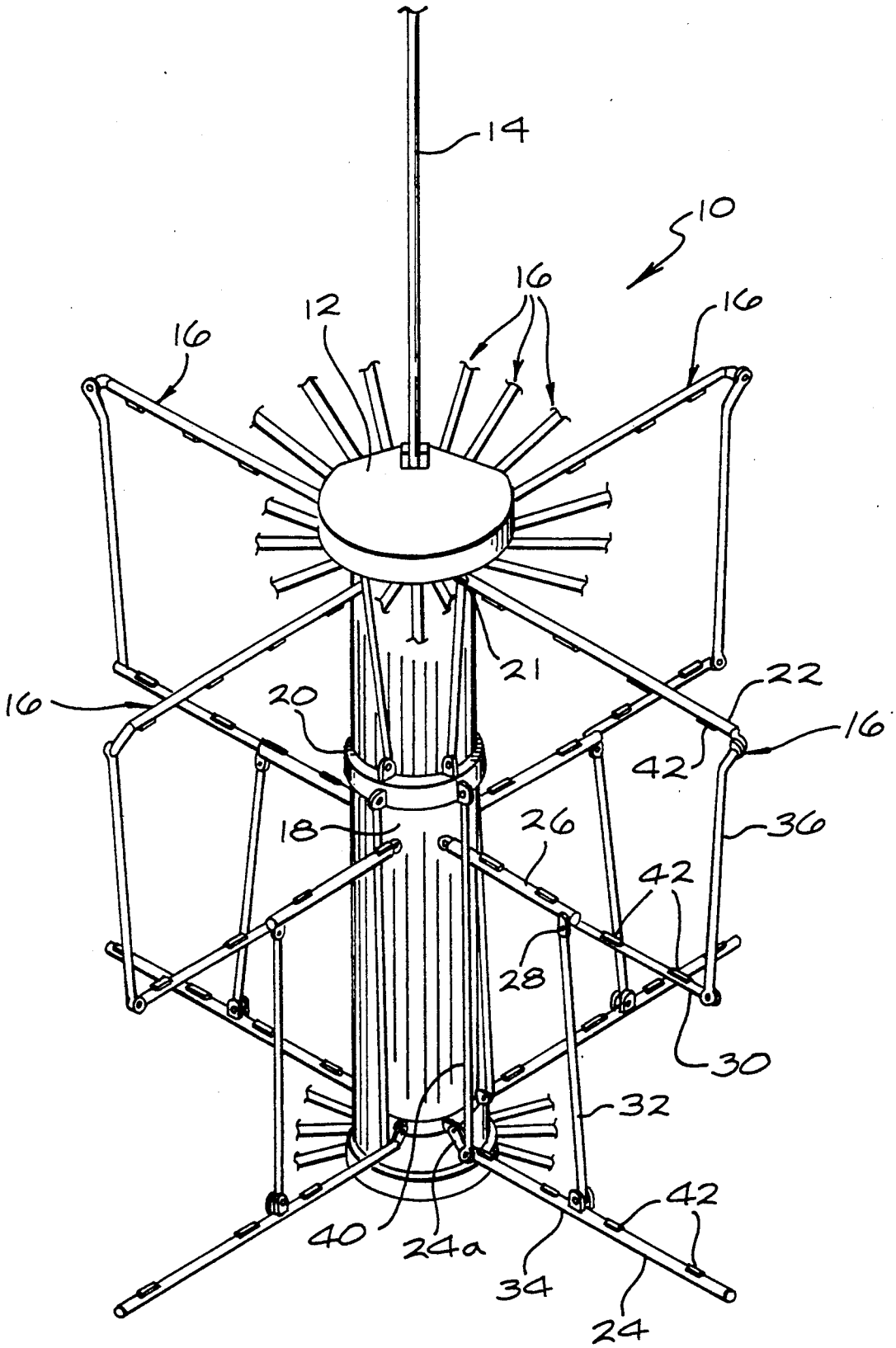
FIG. 1 is a perspective view, partly in phantom, of my transducer array as displayed.

Referring now to FIG. 1, an array structure is shown generally at numeral 10 and includes a cylindrical housing body 12 suspended by means of a cable 14. Fastened to the outside surface of the cylindrical body 12 are a number (in this case, sixteen) of transducer arm assemblies 16, fanned out from the body 12. The housing body 12 contains, or may contain, power sources such as batteries, amplifier and receiving assemblies, and an array of projectors which are also displayed when the array 10 is placed in the water at a desired depth. The projector array forms no part of the present invention.

Figure 2:
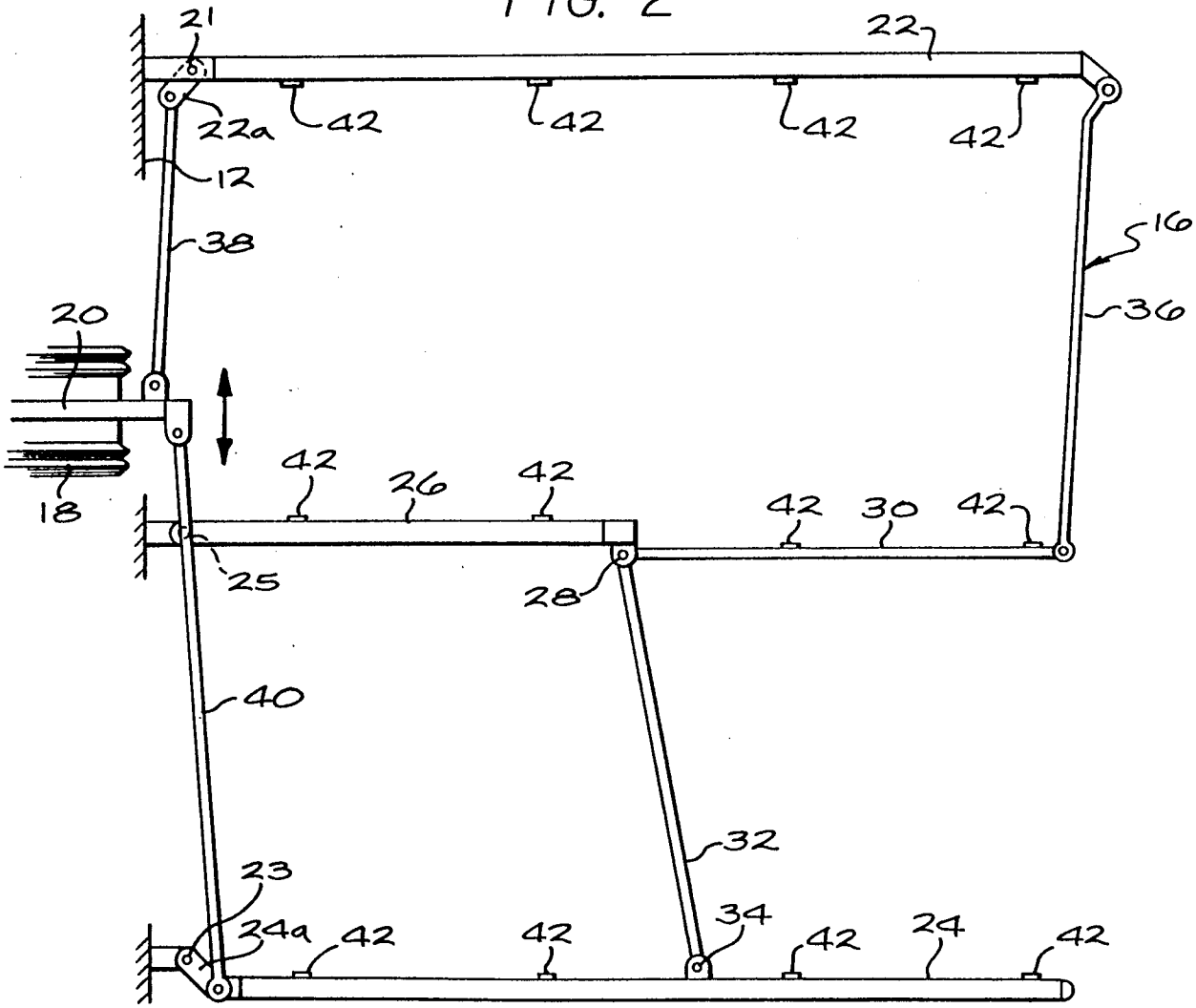
FIG. 2 is a side view of one of the several individual expanding arm assemblies forming the array.

FIG. 2 is a side view of one of the several expanding arm assemblies 16 which carry the receiving hydrophones. Contained within housing body 12 is a motor assembly 18 which may be hydraulically or electrically powered and which responds to a control signal to move a drive member 20 upward to close the array or downward to open the array as indicated. Fastened to pivotal mounting means 21, 23 and 25 on the wall of housing body 12 are a first, or upper elongated arm 22, a second or lower elongated arm 24, and a third arm 26 respectively. At the outboard end of arm 26 and slightly offset therefrom is a pivotal mount 28 to which is attached a fourth arm 30 which, as shown with the array in its open position, extends in the same direction as arm 26. A link 32 is pivotally attached between mount 28 and also to a mount 34 near the center of arm 24. A second link 36 is pivotally attached to the ends of arms 22 and 30.

Arm 22 includes at its inboard end a short lever arm **22*a* bent somewhat away from its main axis. Attached to the drive member 20 and to this short lever arm 22*a* is a pushrod 38. Arm 24 has a similar short lever arm 24*a* at its inboard end, but with the lever arm end attached to housing 12 and a pushrod 40 connected between drive member 20 and the pivotal connection at the outboard end of short lever arm 24*a***.

As will be appreciated, the described connections between the pushrods 38 and 40 and the arms 22 and 24 result in arms 22 and 24 moving in opposite directions irrespective of whether drive member 20 moves up or down. As shown, the arm assembly 16 is in fully open position with drive member 20 in its down position and held there by the motor 18. As drive member 20 is moved upwardly, pushrods 38 and 40 both move upwardly. This causes arm 22 to rotate around pivotal connection 21 moving its outboard end downwardly, arm 24 rotates around pivotal mount 23 which moves its outboard end upwardly, and as it so moves, lever 32 moves upward and carries arm 26 upward. Upward movement of link 32 and pivot 28 causes the left end of arm 30 to move up while its right end is carried downwardly with link 16. This movement continues until all arms and links are folded against the side of housing body 12.

A series of hydrophones 42 are mounted on arms 22, 24, 26 and 30 as shown, with the hydrophones mounted in groups along vertical lines.

Figure 3:
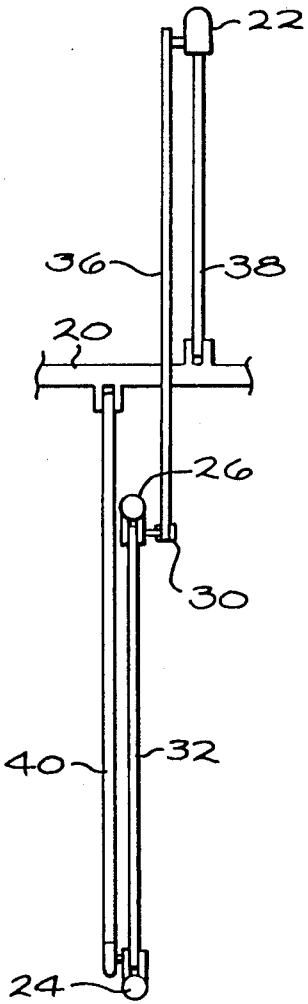
FIG. 3 is an end view of the assembly of FIG. 2.

FIG. 3 is an end view of the assembly of FIG. 2. This view shows the lateral displacement of the various arms, links and pushrods to permit the assembly to fold without interference.

Figure 4:
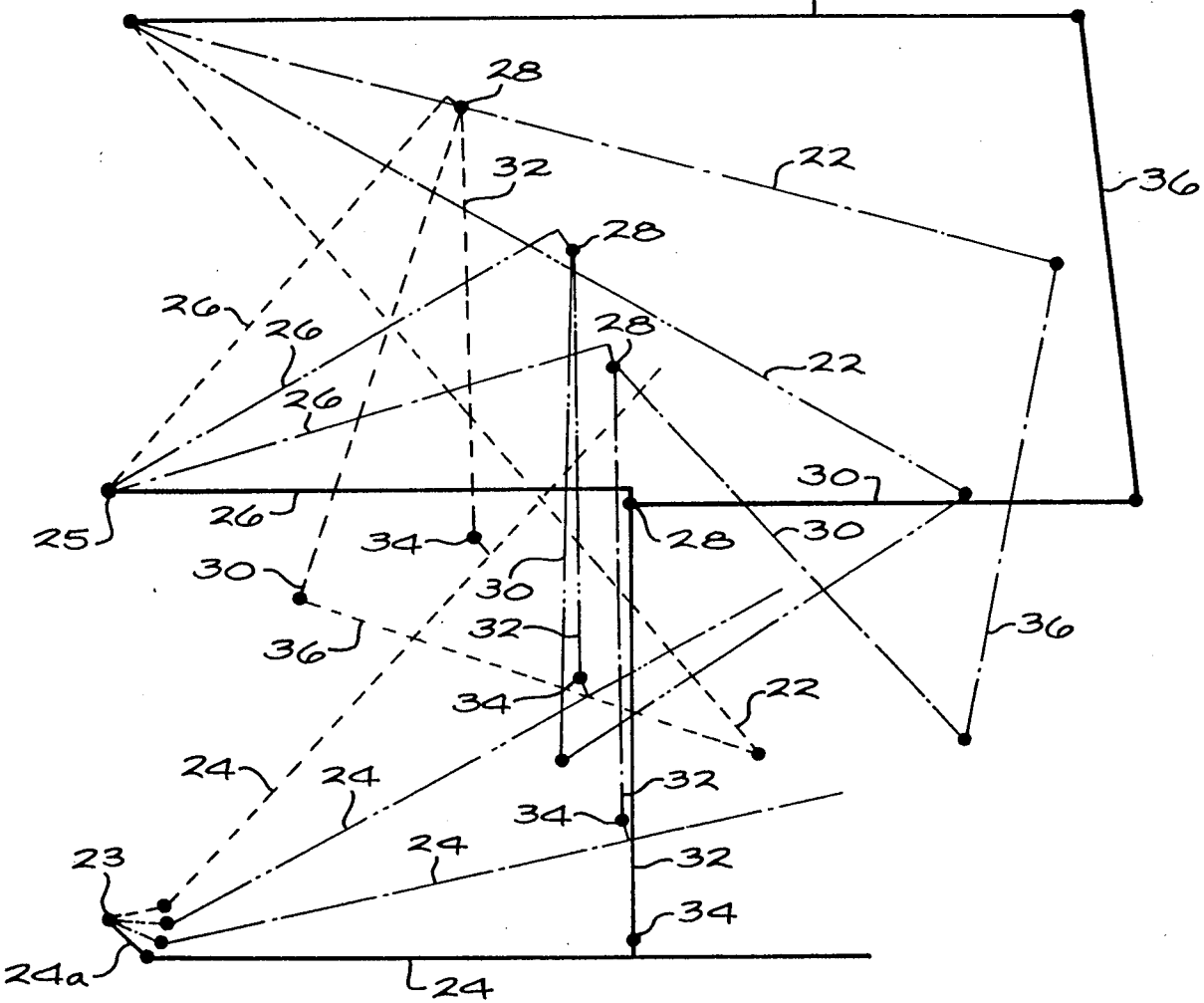
FIG. 4 is a motion diagram, somewhat simplified, showing positions of the individual arms of an assembly such as that shown in FIG. 2 at successive positions during the opening or closing cycle.

FIG. 4 is a simplified motion diagram showing the relative positions of the various parts of arm assemblies 16 as the assembly is opened or closed. In this diagram, the solid line designates the fully expanded position as shown in FIG. 2, and similar numbers are assigned to designate the various arms and links. The pushrods 38 and 40 are not shown, nor is the outboard end of elongated arm 24 which simply moves as an extension of the portion shown and which showing would unnecessarily confuse the diagram. As the assembly begins to fold, the parts assume the positions shown on the dash-dot lines with a single dot. Members 24, 26 and 32 move into a parallelogram arrangement, arm 22 swings downwardly carrying link 36, and arm 30 begins to rotate around pivot 28 as pivot 28 moves upward. Further movement brings the parts to the position shown in the dash-dot line with double dots. At this point, it will be noted that link 32 and arm 30 are almost folded side by side. A still further position is shown in the dashed lines where arms 22 and 24 are folded more than halfway. From this view, it is relatively easy to visualize the movement to the ultimate folded position. As arm 26 moves to a vertical position, it carries pivot point 28 which establishes that arms 30 and link 32 will be essentially side-by-side with arm 26. Arm 24 will also be vertically oriented with its extension (not shown) adjacent link 32; arm 22 will swing down to a vertical position, and as it does, link 36 and arm 30 will be carried to a parallel vertical position beside arm 22. Lever arms **22*a* and 24*a* and their pivots 21 and 23 are arranged to cause arms 22 and 24 to close somewhat outboard of the housing 12 to avoid interference with other members such as arm 26 and link 32**.

A number of modifications may be made within the scope of the present invention. While FIG. 1 shows sixteen arm assemblies 16, other numbers could be used, depending upon the resolution required. Sixteen arm assemblies provide a good beam-forming arrangement with an effective lobe every 22½ degrees. Twelve assemblies would provide less complicated structure at some cost in resolution. Further reductions would be at considerable cost in resolution, but more such arms could be used if the increased resolution for a particular application could justify the increased cost and complexity. A single drive motor is shown driving a single drive member or plate 20. Applicant has also been involved in design and construction of an array in which separate motors and drive plates were used to drive the upper and lower arms. With the drive plates moving in opposite directions, the lever arrangements would be modified; e.g., pushrod 40 would be connected to the inside end of short lever arm **24*a* as in the case of arm 22 rather than outboard of its pivot 23. Or pushrod 38 could be connected to arm 22 in the same manner as pushrod 40 is now shown connected to arm 24**. Additional numbers of radially extending arms could be employed in each arm assembly following the teachings of the present invention, as will be readily apparent to those skilled in the art.

I claim:

1. An expandable sonar array structure constructed to be successively lowered into and raised out of a body of water at the end of a suspension and signal-conducting cable, said structure comprising a body member attached to said cable, a drive member attached to said body member, powered drive means connected to drive said drive member parallel to the axis of said body member, a plurality of essentially identical hydrophone support members pivotally connected to said body and to said drive means, each said hydrophone support member being a combination parallelogram and modified parallelogram linkage arrangement whereby after said hydrophone support members are lowered into the water they are extendable radially from said body, said hydrophone support members being constructed and arranged such that when said array is extended each said support member includes a first arm pivotally attached to said body and pivot means attached at an outboard end of said first arm and displaced slightly out of the plane of said arm, and a second arm attached to said pivot means and extending parallel to said first arm, a stand-off support attached to said body and axially displaced a substantial distance from the pivotal attachment of said first arm and an outwardly extending elongated arm having a pivotal attachment to said stand-off support, a short length of said elongated arm extending inboard of said pivotal attachment at said standoff support and bent away from the axis of said first elongated arm, a second stand-off support attached to said body and axially displaced a substantial distance from said first-named pivotal attachment in the opposite direction from said first-named stand-off support and a second outwardly extending elongated arm having a pivotal attachment to said second stand-off support at its inboard end and oriented essentially parallel with said first arm and said first elongated arm, a short length of said second elongated arm adjacent said second stand-off support being bent away from the axis of said second elongated arm, a first pushrod attached to said drive member and pivotally attached to an inboard end of said first elongated arm, a second pushrod attached to said drive member and pivotally attached outwardly of an inboard end of the pivotal attachment of said second elongated arm to said second stand-off support, a link pivotally attached to said first-named pivot means at one end and pivotally attached to said second elongated arm at a distance along said second elongated arm slightly greater than the outboard displacement of said pivot means, a second link connected between outboard ends of said second arm and said first elongated arm, and a plurality of hydrophones spaced along each of said first and second arms, said first elongated arm, and said second elongated arm with said hydrophones being positioned along substantially vertical lines, whereby operation of said powered drive means while said array is open causes said drive member to move upwardly, resulting in translation of said first and second pushrods upwardly to cause said second elongated arm to rotate its outboard end upwardly around its inboard pivotal attachment to a vertical position while carrying said first link and said first arm to substantially parallel vertical positions against said body and causing said first elongated arm to rotate around its pivotal attachment with its outboard end moving downwardly, causing said second link to move downwardly and rotate around its pivotal attachment with said first elongated arm, carrying said second link and said second arm to substantially parallel vertical positions against said body, thereby folding said array into its closed position, and operation of said powered drive means while said array is closed resulting in reverse operation to extend said array.

2. An underwater sonar array structure constructed to be successively lowered into and raised out of a body of water at the end of a suspension and signal-conducting cable, said structure comprising a body member attached to said cable, radially extending drive means attached to said body member, a plurality of essentially identical hydrophone support members connected to said drive means, said support members including a combination parallelogram and modified parallelogram linkage arrangement whereby after said hydrophone support members are lowered into the water they are extendable radially a substantial distance from said body, said hydrophone support members being constructed and arranged such that when said array is extended each said support member includes a first arm pivotally attached to said body and pivot means attached at its outboard end and a second arm attached to said pivot means and extending parallel to said first arm, a stand-off support attached to said body and axially displaced a substantial distance from the pivotal attachment of said first arm and a first outwardly extending elongated arm having a pivotal attachment to said stand-off support, a short length of said elongated arm extending inboard of said pivotal attachment and bent away from the axis of said first elongated arm, a second stand-off support attached to said body and axially displaced a substantial distance from said pivotal attachment of said first arm in the opposite direction from said first-named stand-off support and a second outwardly extending elongated arm having a short lever arm at its inboard end and a pivotal attachment to said second stand-off support, a first pushrod attached to said drive means and pivotally attached to an inboard end of said first elongated arm, a second pushrod attached to said drive means and pivotally attached to said short lever arm, a link pivotally attached to said first-named pivot means at one end and pivotally attached to said second elongated arm at a distance along said second elongated arm slightly greater than the outboard displacement of said first-named pivot means, a second link connected between outboard ends of said second arm and said first elongated arm, and a plurality of hydrophones spaced along each of said first and second arm, said first elongated arm, and said second elongated arm with said hydrophones being positioned along substantially vertical lines, whereby operation of said powered motor means while said array is open causes said drive means to drive said pushrods to cause said second elongated arm to rotate its outboard end upwardly around its inboard pivotal attachment to a vertical position while carrying said first link and said first arm to substantially parallel vertical positions against said body and causing said first elongated arm to rotate around its pivotal attachment with its outboard end moving downwardly, causing said second link to move downwardly and rotate around its pivotal attachment with said first elongated arm, carrying said link and said second arm to substantially parallel vertical positions against said body, thereby folding said array into its closed position, and operation of said powered drive means while said array is closed resulting in reverse operation to extend said array.

3. An expandable sonar array structure constructed to be successively lowered into and raised out of a body of water at the end of a suspension and signal-conducting cable, said structure comprising a body member attached to said cable, drive means including motor means attached to said body member, a plurality of essentially identical hydrophone support members connected to said body and to said drive means, each said support member including a combination parallelogram and modified parallelogram linkage arrangement whereby after said hydrophone support members are lowered into the water they are extendable radially a substantial distance from said body, said hydrophone support members being constructed and arranged such that when said array is extended each said support member includes a first arm and second and third arms of greater length pivotally attached to said body and extending outwardly, all said arms being essentially parallel to each other, a fourth arm pivotally attached to an outboard end of said first arm, a link pivotally connecting said point of attachment of said first and fourth arms and a pivotal attachment on said third arm outboard of its midpoint, a second link pivotally connecting outboard ends of said second arm and said fourth arm, first and second pushrods pivotally attached to said drive means and to said second and third arms, respectively, a plurality of hydrophones spaced along each of said first, second, third and fourth arms with said hydrophones being arranged along substantially vertical lines, whereby operation of said motor means while said array is open drives said pushrods to cause said second arm to swing downwardly from its pivotal attachment to a vertical position adjacent to said body and said third arm to swing upwardly from its pivotal attachment to a vertical position adjacent said body, said fourth arm and said first and second links are also folded close to said body, and operation of said motor means while said array is closed results in reversing the above operation to extend said array.

4. An expandable sonar array structure as claimed in claim 3 wherein second arm includes a short lever arm extending inboard of its pivotal attachment to said body and said first pushrod is pivotally attached to the end of said lever arm.

5. An underwater array structure as claimed in claim 3 wherein said third arm includes a short lever arm section at its inboard end which is bent out of the axis of said third arm with its pivotal attachment to said body at an inboard end of said lever arm, and with said second pushrod pivotally attached at an outboard end of said lever arm.

6. An underwater array structure as claimed in claim 3 wherein said second arm includes a short bend at its outboard end displacing the pivotal connection with said second link out of the main axis of said second arm and said second link has a short bend adjacent its pivotal connection with said second arm such that when said array is in its closed position said pivotal connection is displaced inwardly toward said body from the main axis of said second arm.

7. A three level cylindrical volumetric sonar array, said sonar array comprising a central vertically elongate body having a height dimension;

an upper and an equal lower horizontal circular fan of elongate arms each of a length substantially equal to said height dimension, each arm pivotally securing at a respective inner end to said body to dispose each fan of arms adjacent a respective end of said body;

a middle horizontal circular fan of elongate arms of a length substantially equal to said height dimension, each arm pivotally securing to said body at a respective inner end to dispose said middle fan of arms midway between said upper and said lower fans of arms, each arm of said middle fan of arms being foldable upon itself intermediate its length; and kinematic linkage means interconnecting drive means with said upper, lower, and middle fans of arms to move the arms thereof between an unfolded position in which the arms fan out perpendicularly to said body and a stowed position in which the arms of the upper and lower fans of arms lay generally parallel along said body and the arms of said middle fan of arms fold upon themselves to nest inwardly of said upper and lower arms;

whereby the stowed height of said sonar array including both body and arms is no greater than its unfolded height.

8. The sonar array of claim 7 in which the arms of said upper and said lower fan of arms are vertically offset and in their stowed position are disposed in side-by-side interdigitation.

9. The sonar array of claim 7 in which the arms of said middle fan of arms each include an inner arm portion pivotally securing to said body and an outer arm portion pivotally securing at its inner end to an outer end of said inner arm portion.

10. The sonar array of claim 9 in which said inner arm portion and said outer arm portion are offset vertically and in said stowed position are nested side-by-side inwardly of said upper and said lower arms.

11. The sonar array of claim 9 in which said kinematic linkage means includes a first link member pivotally connecting at one end to said inner arm portion and pivotally connecting at its opposite end to an arm of one of said upper and lower fans of arms to form a parallelogram linkage therewith.

12. The sonar array of claim 11 in which said inner arm portion, said first link member, and said outer arm portion are offset vertically and in said stowed position are nested side-by-side-by-side inwardly of said upper and said lower arms.

13. The sonar array of claim 11 in which said kinematic linkage means includes a second link member pivotally connected at one end to said outer arm portion outwardly of the pivotal connection of the latter with said inner arm portion, said second link member at an opposite end pivotally connecting with an arm of one of said upper and lower fans of arms to in combination therewith and with said body, said inner arm portion, and said outer arm portions form a five-bar linkage.

14. The sonar array of claim 13 wherein said first link member and said second link member at respective opposite ends thereof pivotally connect to a separate one of said upper and lower fans of arms.

15. The sonar array of claim 7 in which said kinematic linkage means includes a respective linkage means connecting a drive member movable relative said body with the arms of said upper and lower fans of arms to move the latter pivotally between said unfolded and stowed positions.

16. The sonar array of claim 15 in which said drive member moves vertically of said body, and said respective linkage means connects said drive member with arms of said respective upper and lower fans of arms at respective pivotal connection points located at one fan of arms inboard of and at the other fan of arms outboard of the pivotal connection of said arms with said body.

* * * * *